United States Patent [19]

Munroe

[11] 4,257,664

[45] Mar. 24, 1981

[54] SCREW SOCKET FOR AN ELECTRIC LAMP

[75] Inventor: Ronald G. Munroe, Georgetown, S.C.

[73] Assignee: Eagle Electric Mfg. Co., Inc., Long Island City, N.Y.

[21] Appl. No.: 18,719

[22] Filed: Mar. 8, 1979

[51] Int. Cl.[3] ..... H01R 13/42

[52] U.S. Cl. ..... 339/95 D; 339/119 L; 339/176 L; 339/217 S

[58] Field of Search ..... 339/95 D, 119 L, 124, 339/128, 59 L, 178, 179, 180, 176 L, 217 S

[56] References Cited

U.S. PATENT DOCUMENTS

| | | | |
|---|---|---|---|
| 2,721,985 | 10/1955 | Gilbert | 339/124 X |
| 2,975,392 | 3/1961 | Ludwig | 339/99 L |
| 2,988,725 | 6/1961 | Vallee | 339/126 RS |
| 3,060,399 | 10/1962 | Pistey | 339/95 D X |
| 3,206,710 | 9/1965 | McLaughlin | 339/95 D |
| 3,783,435 | 1/1974 | Fisher | 339/128 X |
| 3,967,873 | 7/1976 | Schumacher | 339/95 D |

FOREIGN PATENT DOCUMENTS

| | | | |
|---|---|---|---|
| 228882 | 8/1963 | Austria | 339/178 |
| 564066 | 2/1933 | Fed. Rep. of Germany | 339/180 |

*Primary Examiner*—John McQuade
*Assistant Examiner*—John S. Brown
*Attorney, Agent, or Firm*—Kirschstein, Kirschstein, Ottinger & Cobrin

[57] ABSTRACT

A screw socket for use as a part of a lighting device such as a table or floor lamp or a ceiling or wall fixture. The screw socket includes a synthetic plastic screw husk having several new features, namely, (a) two one-piece metal strips, each of which at one end is formed into a contact for the screw thread base of a lamp and at the other end is formed into a push-type power termination for connection to the bare core of a sheathed electric conductor, each strip further including anchoring means, and additionally comprising locating means to inhibit twisting of the strip, (b) a hickey including a longitudinally gapped threaded nipple formed in one piece with an offset footed pedestal, (c) raised wiring bosses containing the push-type power terminations, and (d) alternately, instead of or in addition to the anchoring means and the locating means in one piece with each strip, a wedging means to accomplish the same functions.

17 Claims, 10 Drawing Figures

SCREW SOCKET FOR AN ELECTRIC LAMP

BACKGROUND OF THE INVENTION

1. Field of the Invention

A fixture socket.

2. Description of the Prior Art

Screw sockets are well-known commercial items for lighting devices. Many types of sockets are available. One conventional socket has a metallic screw-threaded sleeve for engagement with the screw base of a bulb and also has a central cantilever leaf spring for engagement with the center button of a lamp bulb base. The sleeve and central contact are secured to an electrically non-conductive base that is provided with screw-type electric terminations, and the sleeve and base are protected by a thin, usually paper type, electrically non-conductive sleeve. The sleeve is contained within a two-piece thin metal cover. Suitable switch control means extends from the metal sleeve/base combination through the paper sleeve and cover for external manipulation. The cover is provided with an opening through which a power cord is threaded. The ends of the power cord are stripped and connected to the screw-type terminations.

Other conventional sockets are fashioned with internally threaded electrically non-conductive sockets containing internal contacts. The contacts are connected to a power cord either by soldering, welding, screw-type terminations, or tines that extend through unstripped electrically non-conductive sheaths. Push-type wire terminations are also employed but usually not in association with screw sockets. Push-type terminations are designed to engage a stiff wire core which is thrust into an electric device, for example, a duplex outlet, or a cube tap, or an electric heating appliance, or an electric motorized appliance. The stiff core is arranged to brush past and deflect the cantilever tip of a leaf spring which presses against the core and resists any attempt to pull the core back.

A push-type connection is illustrated in U.S. Pat. No. 3,805,211, although the same is not typical because it is especially designed to be used with spade terminations.

Prior art sockets frequently are used with lighting fixtures in which the socket is supported on some element of the fixture or on a stationary structural element. Customarily, the connection is effected physically with the aid of pipes, and intermediate threaded devices are employed which threadedly engage the socket and the element. However, in addition to the physical connection that must be arranged for, an electric connection must be provided between the house power lines and the socket. The electric connection is obtained by running power lines usually through a pipe and then into the socket where it engages the power terminations of the socket. There is a problem in that it is inconvenient and usually impossible to thread the wires through the pipes and into the socket after the physical connections have been made and also to minimize the length of the run of wire. Heretofore, to partially overcome the problem, a hickey has been employed. A hickey is a device which constitutes a pair of short threaded nipples interconnected by diametrically opposite straps that leave a space between them for threading of a wire through the nipple. Thus, a wire can be pulled from a power source in a building out through the space between the straps and then re-introduced in that space for connection to the socket. The use of hickeys, however, still made the electric connection to the socket an awkward one. Its use was time consuming and it did not readily permit the shortening of the run of wire.

SUMMARY OF THE INVENTION

1. Purposes of the Invention

It is an object of the invention to provide an improved electric screw socket.

It is another object of the invention to provide an electric screw socket with a novel hickey that facilitates insertion of an electric power line after physical mounting of the socket.

It is another object of the invention to provide an electric screw socket and hickey of the character described in which an electric wire can simply be laid into the hickey after electric connection of the wire to the socket.

It is another object of the invention to provide an electric screw socket having a novel combination of contact and wire termination which reduces manufacturing costs without sacrificing reliability, durability or ease of assembly.

It is another object of the invention to provide an electric screw socket having a different kind of wire termination that lends itself to rapid, secure, physical and electric connection between a house line and the socket.

It is another object of the invention to provide a new type of hickey which is capable of use with electric devices other than sockets and which is characterized by the ability to introduce the wire into the hickey after an electric and a physical connection have been made between the wire and the device.

It is another object of the invention to provide an electric screw socket in which wire terminations of the push type are contained within raised bosses so that the terminations are not cramped and yet in which the bosses do not increase the effective length of the socket which is considered to be the distance between the nipple portion of the hickey and the socket mouth into which a bulb is introduced.

It is another object of the invention to provide an electric device with a push-type termination of novel structure in which the wire core tends to be offset so as to form a strain relief.

Other objects of the invention in part will be obvious and in part will be pointed out hereinafter.

2. Brief Description of the Invention

The electric screw socket of the present invention includes an electrically non-conductive husk with a closed bottom and an open mouth forming a well. The well is shaped to include a fragmentary female screw thread of the proper dimensions and configuration to receive the screw base of an electric light bulb.

Along the internal sides of the husk diametrically opposed slots are formed to receive parts of contacts for the bulb base. There are two such contacts. Each contact includes in one piece a portion designed to engage a part of the lamp base, either the central button or the threaded base shell, another portion which is constructed and arranged to receive a push-in stripped core of a sheathed electric wire, and a third portion which anchors the contact to the side wall of the husk. This third portion also includes a locating means to inhibit twisting of the contact. The push terminations of the strips have their tips adjacent undercut segments of the walls of the husk adjacent the closed base thereof, the purpose of the undercuts being to permit deflection of inserted wire cores so that the tips of the cantilever terminations can create such deflection and thereby furnish a form of strain relief.

The base of the husk is fashioned with through openings adjacent the tips of the cantilever terminations, thereby allowing insertion of the stripped wire ends. Each strip is formed with a generously curved segment from which the cantilever part of the wire termination extends. This curvature eases flexing of the cantilever termination, thereby enabling the use of a somewhat heavier strip than otherwise would be required for this type of cantilever action and, hence, making the contacts and terminations quite rugged and durable.

The intermediate portions of the strips at which the anchoring and locating means are provided are designed to bear against the opposite walls of the husk and to be held in that position by portions of the strip engaging slots in the side walls of the husk. The anchoring means in one form of the invention constitutes a resilient prong on each strip which extends away from the strip toward the wall of the husk and which, upon insertion of the strip, is forced past a protuberance on the wall and, after clearing the protuberance, snaps behind a shoulder that forms an edge of the protuberance and prevents the strip from being withdrawn from the mouth of the husk.

Instead of or in addition to the anchoring and locating means, the screw socket can include an electrically non-conductive disc which is slipped into the socket after the strips have been emplaced and which is arranged, when installed, to bear against an intermediate portion of each strip and exert a pressure thereon in a direction toward the base of the husk.

A hickey is secured to the socket so as to be integral therewith. The hickey constitutes a threaded nipple which preferably is centered on the longitudinal axis of the husk and is secured to the husk by an offset footed pedestal, the point of securement of the pedestal being displaced from the longitudinal axis of the husk to provide a clear space between the wire termination entry openings and the threaded nipple. The nipple itself is unusual in that it is formed with a longitudinally extending gap, i.e. slot.

When the socket is used, the nipple is screwed to a fixed pre-installed threaded element. Then the house wires are drawn toward the socket and their ends are stripped and inserted into the wire termination openings. At this point, the wires can be pulled to shorten their run while the wires are away from the hickey nipple and, finally, the wires are inserted laterally into the hickey nipple through the slot to contain the same. If the pre-installed element is hollow and house wires are to be drawn through it, the same sequence of steps can be effected except that a portion of the wire will be in place within the husk before the run of wire is shortened and the pulling of the wire automatically will shift the wire into the full length of the nipple.

The invention consists in the features of construction, combination of elements, arrangement of parts and series of steps which will be exemplified in the device hereinafter described and of which the scope of application will be indicated in the appended claims.

BRIEF DESCRIPTION OF THE DRAWINGS

In the accompanying drawings in which are shown various possible embodiments of the invention.

DESCRIPTION OF THE PREFERRED EMBODIMENTS

Figure 2:
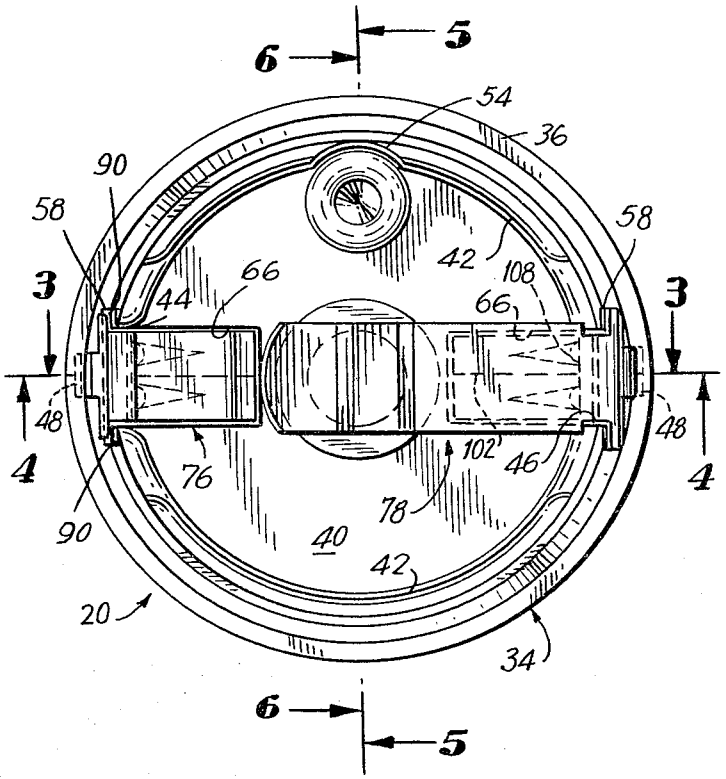
FIG. 2 is a top view of the socket looking into the mouth of the husk.
Figure 1:
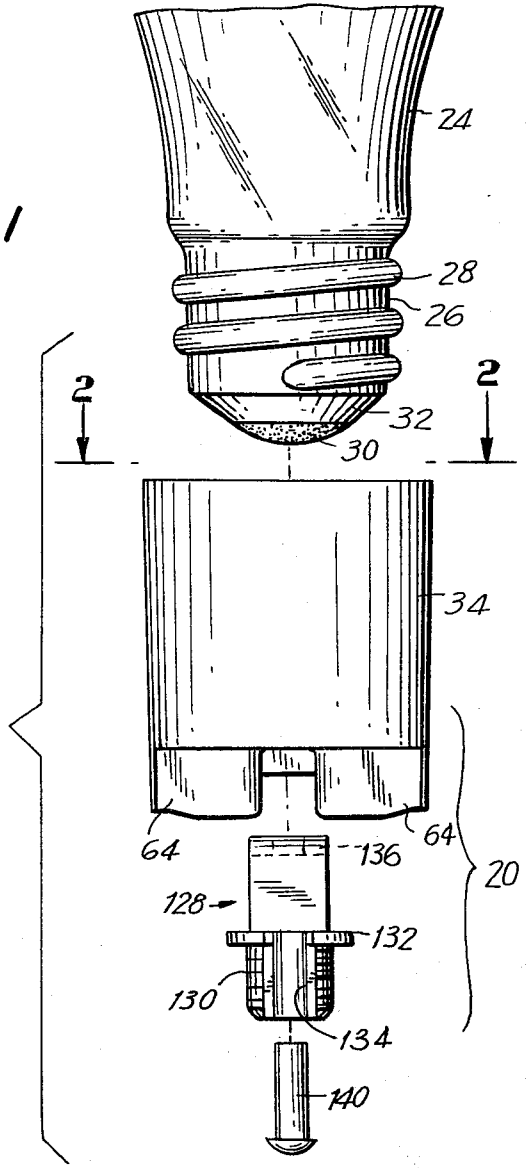
FIG. 1 is an exploded side view of the electric screw socket of the invention together with a fragment of a light bulb designed to be received therein.

Referring now in detail to the figures, and more particularly to FIGS. 1–7, the reference numeral 20 denotes an electric screw socket in accordance with the present invention, and the reference numeral 22 denotes a conventional electric bulb which the screw socket is designed to receive. The bulb is of the incandescent type and includes a glass envelope 24 cemented to an electrically conductive base 26 having male threads 28 thereon. The bottom of the bulb is formed with an electrically conductive central button 30 separated from the base 26 by electric insulation 32.

The socket 20 includes an electrically non-conductive husk 34 typically made from a phenolic condensation resin. The socket is provided with paraphernalia which will be described later. Said husk is approximately of cylindrical shape and is formed with a side wall 36 that terminates at one end in an open mouth 38 and at the other end is closed by a bottom wall 40. Thus, the husk supplies a blind well which is designed to receive the base 26 of the bulb 22. In order to fit the bulb base, the internal surface of the side wall is formed with a female screw thread 42.

In order to permit emplacement of the paraphernalia associated with the husk, the screw thread is mutilated, e.g. interrupted or deformed, at various portions thereof. Thus, the screw thread is interrupted at diametrically opposite portions thereof by longitudinal slots 44, 46 that accommodate contact/termination strips subsequently described. Each of said slots 44, 46 extends from the open mouth 38 of the husk to the bottom wall 40. Centrally of each slot 44, 46 the husk is formed with a deeper slot 48 that is narrower than the associated slot 44, 46. The narrower slot runs from the mouth of the husk but terminates short of the bottom wall. The ends of the slots 48 near the bottom wall 40 stop at inwardly directed bosses 50 that provide shoulders 52 substantially perpendicular to the longitudinal axis of the husk and facing the bottom wall 40.

Figure 4:
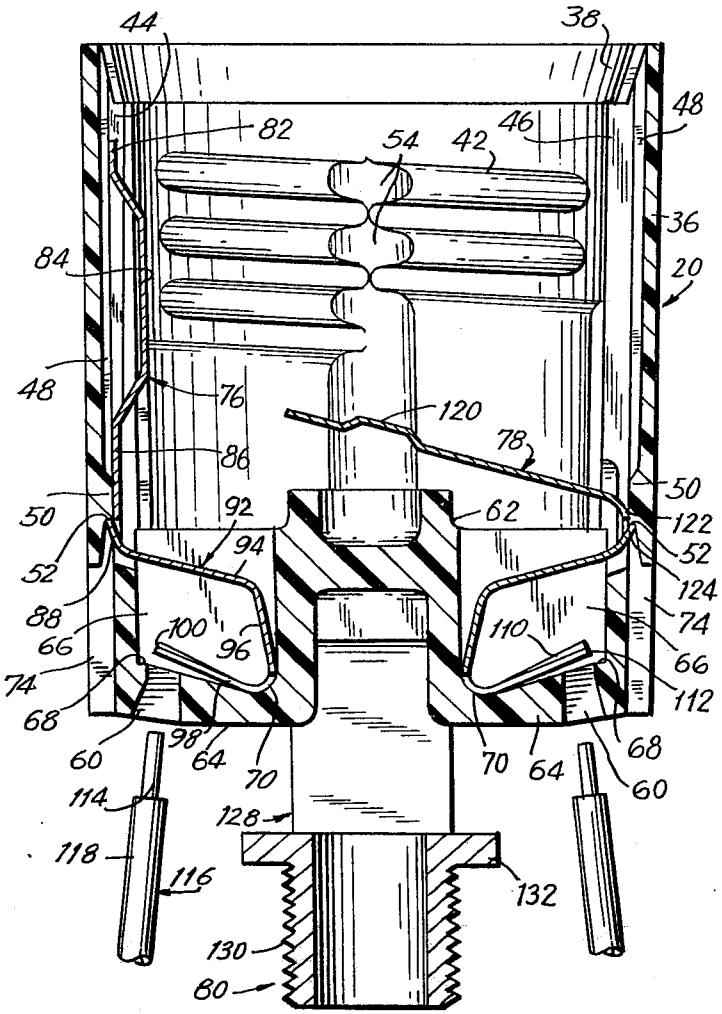
FIGS. 4, 5 and 6 are longitudinal sectional views taken substantially along the lines 4—4, 5—5 and 6—6, respectively, of FIG. 2.
Figure 3:
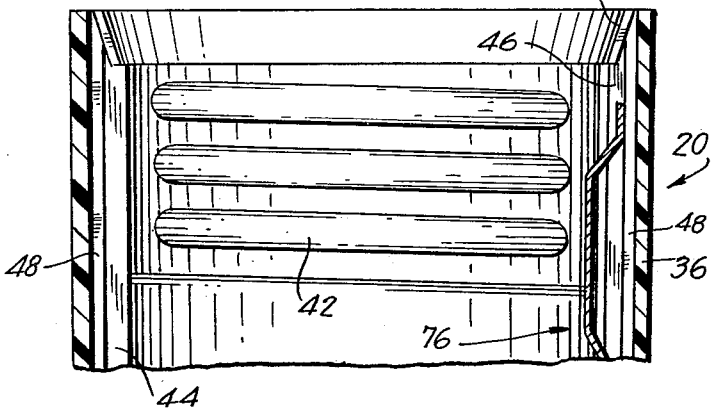
FIG. 3 is a fragmentary longitudinal sectional view taken substantially along the line 3—3 of FIG. 2.

Another interruption in the threads 42 is located 90° away from the slots 44, 46 and best can be seen in FIG. 4. This interruption constitutes a longitudinally aligned set of grooves 54.

The slots 44, 46 are exposed for most of their length extending from the open mouth toward the bottom wall 40. However, the sides of portions of the slots 44, 46 adjacent the bottom wall are covered by flanges 56, thereby forming side channels 58 (see FIG. 2). The flanges 56 run almost the full length of the slot 44 but are shorter over the slot 46 because, as will be appreciated subsequently, the portions of the contact/termination strips which ride in these channels are located near the mouth of the husk for one of the strips and near the bottom wall of the husk for the other of the strips.

The bottom wall 40 includes two diametrically opposed oblong wire-admitting openings 60. These openings are aligned with the slots 44, 46. The openings 60 flare outwardly so that they are largest at the outer surface of the bottom wall, being thus configured to facilitate and guide entry of the stripped wire cores of electric leads.

A circular protuberance 62 extends into the well of the socket from the internal surface of the bottom wall 40, the same being included for a certain function which it provides in the modified form of socket subsequently to be described.

The length of the socket from its open mouth to the bottom wall is controlled by the length of the base of the bulb. However, in practice, the length of the socket is considered to be the distance from the open mouth of the husk to a nipple, hereinafter described, which is used to physically connect the socket to a pre-installed element. The length of the husk, as determined solely by the length of the base of the bulb, is insufficient to enable the husk to be used as a push-type termination. Yet, it is undesirable to extend the length of the socket in order to enable such a termination to be employed.

The present socket solves this problem without increasing the length of the socket by forming wiring projections 64 on diametrically opposed sides of the exterior of the bottom wall 40. These projections are internally hollow, thereby providing pockets 66 (see FIG. 4). The pockets are in line with the slots 44, 46 and are of approximately the same width. Said pockets also are in radial alignment with the openings 60. It will be observed that the junction between each pocket 66 and the associated side wall of the husk is displaced outwardly from the inner end of the associated opening 60, thereby forming a shoulder 68 which faces toward the open mouth of the husk and is substantially perpendicular to the longitudinal axis of the husk. The inner corner 70 of each pocket is generously rounded for a purpose which will be pointed out later.

Figure 7:
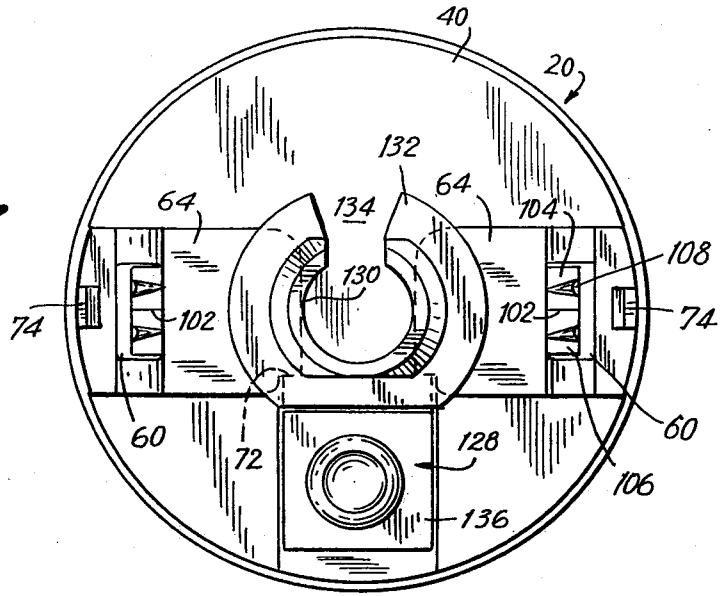
FIG. 7 is a bottom plan view of the socket.

The projections 64 are in diametrical alignment as best shown in FIG. 7, and one pair of common side walls thereof are indented to mutually provide a trough 72 extending from the external ends of the projections 64 to the bottom wall.

To facilitate molding of the shoulders 52, the radially outer side walls of the projections 64 are indented as at 74.

Associated with the husk are a side contact/wire termination strip 76 and a central contact/wire termination strip 78. These strips are, as usual, made from electrically conductive resilient material, for instance, spring brass or phosphor bronze. The strips employed in the preferred form of the invention have a rectangular cross-section of 0.012″×0.3″.

Also associated with the husk is a hickey 80.

The strip 76 is a long piece of metal of complex configuration designed to achieve several functions. Because it is a single piece individually, as is the strip 78 which likewise is designed to perform several functions generally similar to those of the strip 76, both strips can be made and assembled with the husk at a cost considerably less than that required heretofore in contact strips employed in association with plastic husks. Prior strips conventionally individually constituted two or more pieces which were usually mounted separately in the husk and, therefore, engendered manufacturing costs considerably greater than those of the present socket. Moreover, due to their individual unitary nature, the two strips can be mounted with less cost and greater speed in the husk.

Reverting to the strip 76, the mouth end 82 thereof is of a width which fits nicely in the slot 44. Said strip has an inwardly directed long flat contact portion 84 adjacent the mouth end 82. The contact portion 84 runs longitudinally of the socket and is high enough to project partially within the crest circle of the screw thread 42 whereby when the base 26 of the electric bulb is screwed into the thread 42 it will physically and electrically engage the side contact 84. Unitary with the other end of the contact portion 84 is an intermediate section 86. The intermediate portion is at the same level as the mouth end of the strip and bears against the internal surface of the associated boss 50 (see FIG. 4). The end of the intermediate portion adjacent the bottom wall is provided with a tine 88 in one piece therewith. The tine projects radially outwardly from the strip and is so located that its free end, when the strip is assembled with the husk, will bear against the shoulder 52. The intermediate portion is provided with laterally protruding ears 90 (see FIG. 4) which ride in the channels 58 under the flanges 56. The cooperation between the tine 88 and the shoulder 52 provides an anchoring means for the strip 76. The cooperation between the ears 90 and the channels 58 provides a locating means for the strip 76. At the other end of the intermediate portion 86 the strip is formed with a J-shaped wire termination 92. Said termination includes a radially inwardly extending reach 94 which runs into an intermediate reach 86 that terminates at a wire-engaging reach 98. The junction between the intermediate reach 96 and the wire-engaging reach 98 is generously curved to substantially match the curve of the corner 70. It will be noted that the wire-engaging reach 98 is in the form of a cantilever, being supported by the intermediate reach 96 at its radially inner end and having a free tip 100. This generous curvature of the corner 70 and of the junction between the intermediate reach and the wire-engaging reach affords an easier flexing of the cantilever reach 98 so that a heavier gauge of material may be used for the strip 76 without interfering with its ease of operation for push-wire engagement.

The wire-engaging reach 98 is centrally slit as at 102 (see FIG. 7) whereby to divide this reach into two prongs 104, 106. The slit runs from the free tip 100 to the junction between the intermediate reach 96 and the wire-engaging reach 98 so that each prong has the desired degree of flexibility. In order to afford a greater degree of contact between the tip of each prong and the wire core to be engaged thereby, the center of each tip is formed with an arcuate concave recess 108 (see FIG. 7). Each prong is fashioned with a ridge 110 (see FIG. 4) extending from the free tip thereof toward but not to the junction between the intermediate reach and the wire-engaging reach in order to stiffen the prong and yet permit it to flex about said junction. The outer end of each prong 104 lies directly in line with the associated opening 60 (see FIG. 4) so as almost to block the same against intrusion of any external object. The tips of the prongs, considered in a radial sense, are a very short distance inwardly from the radially outer wall of the associated opening 60.

It is pointed out that the wire-engaging reach is directed outwardly and toward the open mouth of the husk so as to be at an angle less than 90° to the longitudinal axis of the husk. Thereby, the corner 112 of the tip of each of the prongs presents a sharp edge to any element introduced into the husk through an opening 60. Furthermore, the tip of each prong is spaced a short distance from the shoulder 68 in a direction toward the open mouth of the husk.

To make a wire connection to the strip 76, the electrically conductive core 114 of an electric wire 116 is exposed at an end of the wire by stripping off the electrically insulating sheath 118 therefrom. Preferably, the core is solid wire. However, the invention will also work with stranded wire provided that the same is somewhat stiffened as by twisting the same. As shown in FIG. 4, this stripped end of the wire is aligned with an opening 60 and preferably is aligned with one or the other of the prongs 104. The end of the wire then is introduced into the hole where it encounters the cantilever reach 98, at this time, as just mentioned, preferably being aligned with one or the other of the prongs 104. The wire is pushed against the prong and, by so doing, will flex the same downwardly and centrally inwardly to provide a passageway for the wire between the tip of the prong and the radially outward wall of the inner end of the opening 60. In so doing, the wire will push past the corner 112. After the wire has been pushed past a sufficient distance, the prong will deform the wire somewhat to deflect it against the inner wall of the associated pocket 66. This will bend the wire under the shoulder 68. With the wire in this out-of-linear configuration, when any attempt is made to pull the wire out of the opening, the corner 100 will dig into the wire and tend to prevent such movement. Furthermore, the now-offset configuration of the wire will bear against the shoulder 68 and further inhibit retrograde movement of the wire so that the wire, once inserted, cannot easily be removed. If it is desired to remove the wire, electricity is disconnected and a slender tool is inserted in the opening 60 until the reach 98 is deformed enough to enable the wire to be pulled out.

Turning now to the center strip 78, it has a contact portion 120 which extends in cantilever fashion to its free end from an interior wall of the husk. The strip crosses the center of the husk in spaced relationship from the bottom wall 40 and a short distance away from the inner end of the protuberance 62, thus providing sufficient clearance for deflection of the contact portion when engaged by the button 30 upon insertion and screwing home of the base 26. The wall end of the contact portion is integral with an intermediate portion 122 that lies in the slot 46. This intermediate portion, like the corresponding intermediate portion 86 of the side strip 76, is provided with an outwardly inclined tine 124 designed to engage the shoulder 52 associated with the slot 46. Connected to the intermediate portion is a J-shaped wire termination portion 126 which is identical to the J-shaped wire termination portion 92 of the strip 76.

To assemble the strips 76, 78 with the husk, they simply are introduced into the open mouth 38 of the husk aligned with their respective slots 44, 46 and pushed toward the bottom wall. The intermediate portions of the two strips are, at this time, snugly disposed in their associated slots. As the strips are pushed inwardly, the tines 88, 124 will engage the bosses 50 and be deflected radially inwardly by such engagement until the bosses are cleared, whereupon the tines will spring out to engage the shoulders 52. At this time, the junction between the intermediate reaches and wire-engaging reaches of each J-shaped wire termination will bear against the corner 70 so that the segment of each strip between such junction and the associated shoulder will be under compression. Thus, the strip will be held firmly in place. The cooperation between the ears 90 and the channels 58 also aids in locating the two strips during and after assembly.

The hickey 80 is made of a strong, preferably rigid, material. For instance, it is a zinc die cast material. The hickey consists of two major parts, namely, a pedestal 128 and a threaded nipple 130 which constitute a single piece. The nipple is externally threaded for engagement with a pre-installed element, e.g. a stud or a pipe, which is internally threaded. If desired, the nipple may be internally threaded for engagement with an element such as a stud or a pipe which is externally threaded. The nipple is disposed in alignment with the longitudinal axis of the husk and is located a short distance, e.g. ¼", from the projections. The end of the nipple closest to the projections is provided with an outwardly extending flange 132 to act as a stop to prevent the nipple from being screwed too far into a female threaded element.

The husk is unusual in that the nipple 130 is formed with a longitudinal gap 134 running the full length thereof. This gap is wide enough to permit a sheathed electric wire to enter the nipple laterally, that is to say, to enter the nipple from its side without being threaded through the nipple.

Figure 6:
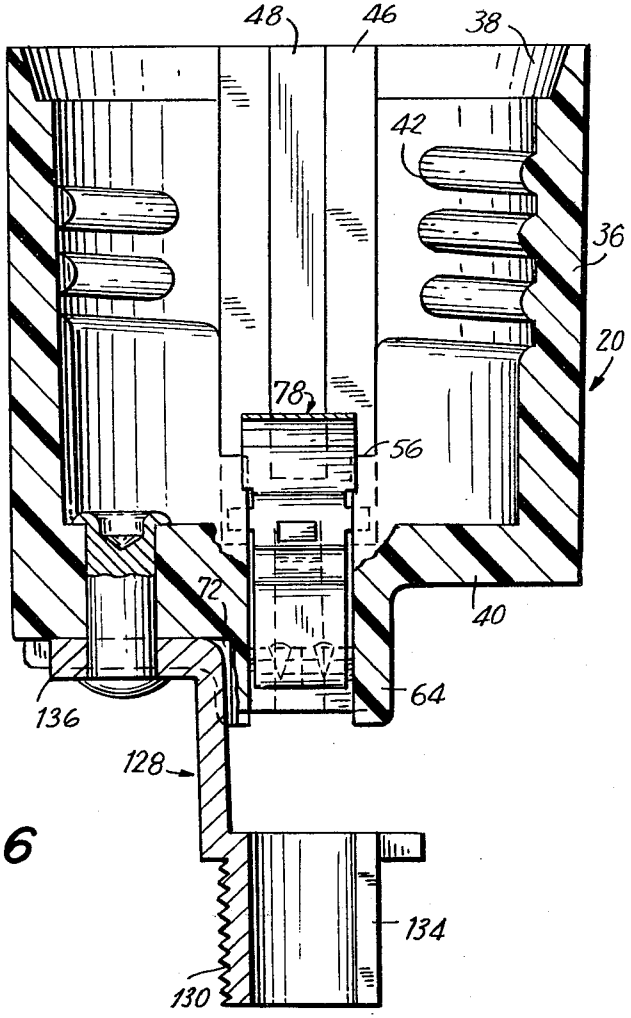
Figure 5:
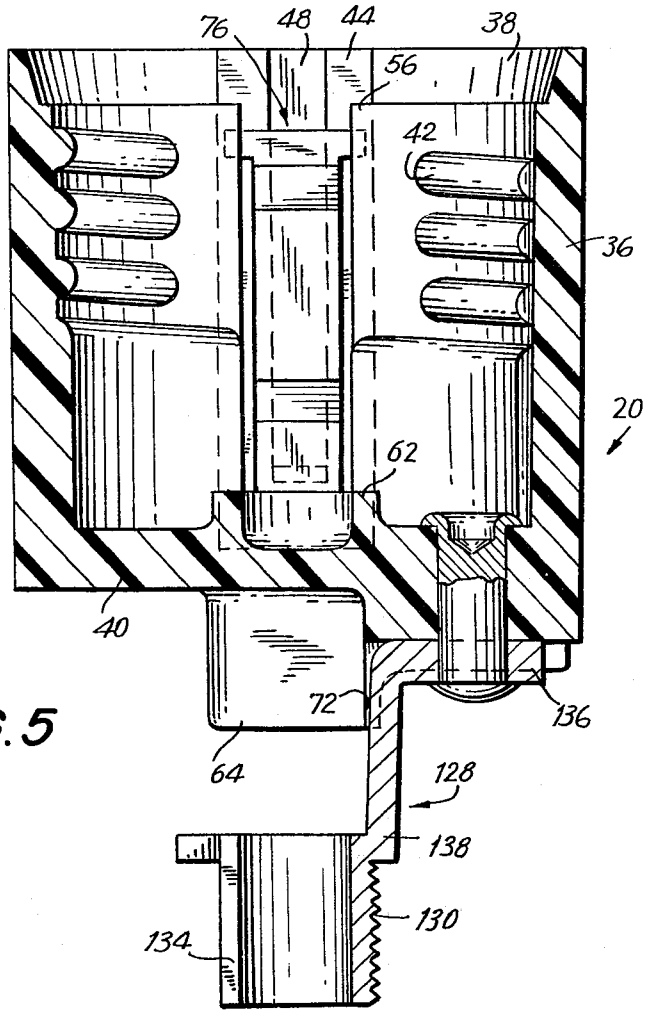

The pedestal 126 has a foot 136 that is abutted against the external surface of the base wall 40, optionally against a raised portion thereof as indicated in FIGS. 5 and 6. The inner end of the pedestal, that is to say, the end closer to the longitudinal axis of the husk, is seated in the trough 72. This inner end is connected by a leg 138 partially seated in said trough to the end of the nipple closer to the husk. The leg 138 extends longitudinally. The foot is secured to the base wall in any suitable manner, for example, by a rivet 140, the head of which abuts the outer surface of the foot, and the shank of which extends through registered openings in the foot and base wall. The inner end of the rivet is spun to engage the internal surface of the base wall.

The reason for the provision of twin prongs in each of the wire-engaging reaches is that the second prong is intended to be employed for a shunt connection to another socket.

Figure 8:
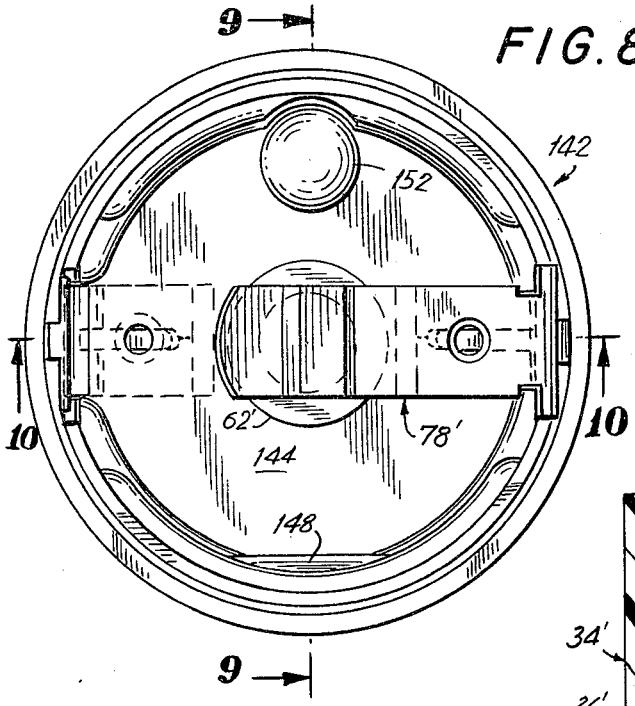
FIG. 8 is a view similar to FIG. 2 of a socket embodying an alternate form of the invention.
Figure 9:
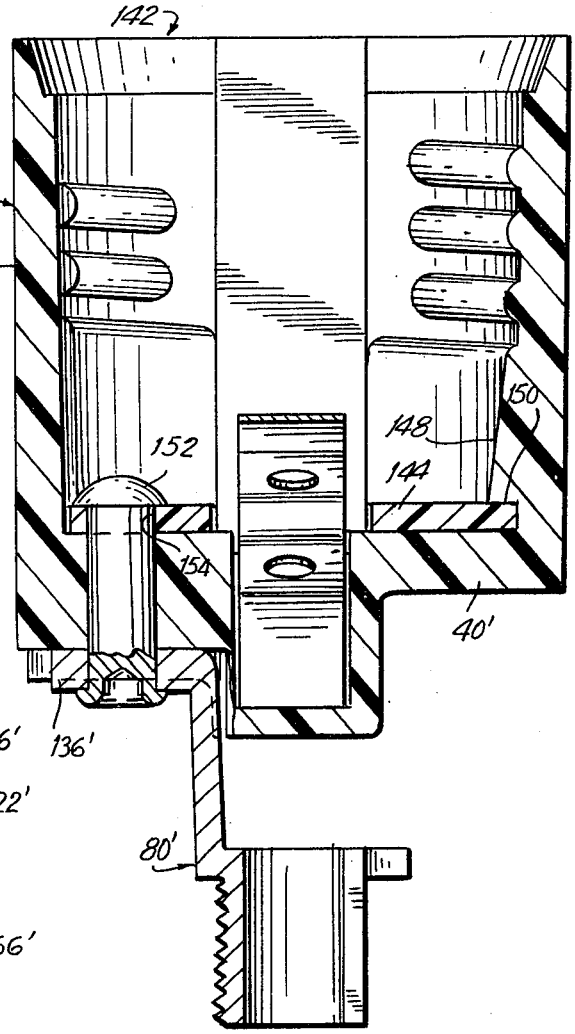
FIGS. 9 and 10 are longitudinal sectional views taken substantially along the lines 9—9 and 10—10 of FIG. 9.
Figure 10:
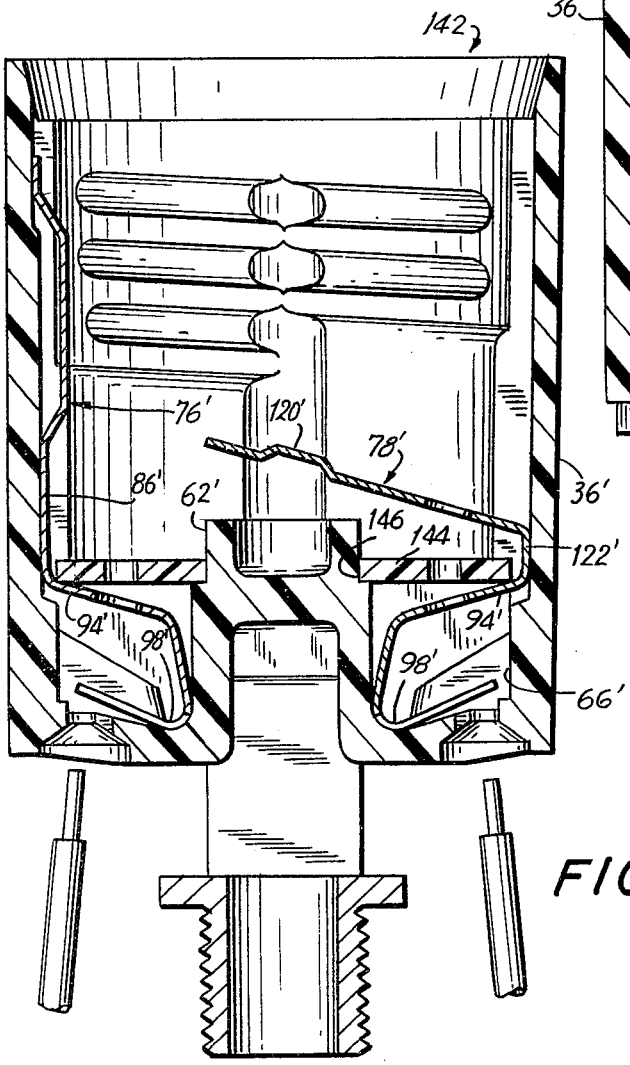

The reference numeral 142 denotes a modified form of socket, the same being illustrated in FIGS. 8–10. In large part, the sockets 20 and 142 are identical, and no description of like details will be given. The basic difference between the two sockets is in the arrangement for anchoring and locating two contact/wire termination strips. Said strips and said parts are identified by the same numerals as those employed in the description of the socket 20 except that the strips and parts thereof used in the socket 142 have been primed. The strips 76', 78' of the socket 142 have no ears such as the ears 90. Nor does the husk 34' of the socket 142 have channels 58. Instead, and for the purpose of anchoring and locating the strips 76', 78', the socket 142 is supplied with an electrically non-conductive wedging disc 144 which may be made, for instance, of fiberboard, flakeboard, masonite, phenolic resin, or ceramic. The disc has a central opening 146 in which the protuberance 62' is snugly receivable.

The husk 34' differs from the husk 34 in that the husk 34' includes an internal ridge 148 (see FIG. 9) that terminates near the base wall at a shoulder 150.

The strips 76', 78' are inserted in the husk 34' by slipping the same in from the open mouth toward the base wall until the reaches 98' strike the bottoms of the pockets 66'. At this time, the strips are not yet anchored in the husk, although they can be if the husk and strips are provided with co-acting tines and shoulders and with co-acting ears and channels. Nevertheless, even in the absence of such tines, shoulders, ears and channels, the strips 76', 78' will be anchored and located in the husk 34' with the aid of the wedging disc 144. This disc is introduced into the husk after the two strips are emplaced. The disc is tilted and it is introduced so that it can slip under the free end of the contact portion 120'. The leading end of the disc is shifted toward and against the intermediate portion 122' of the strip 78' and also toward and over the shoulder 150. Prior to entering over the shoulder, it may be slid along the ridge 148 toward the bottom wall 40'. The portion of the disc diametrically opposed to the portion of the disc which engages the shoulder 150 is forced against the opposed part of the bottom wall 40'. It is held there by the head of a rivet 152 which preferably is the same rivet that holds the foot 136' of the hickey 80' in place. The disc is formed with a radially inwardly extending slot 154 to pass the shank of the rivet 152.

The disc engages both intermediate portions 86' and 122' of the two strips 76' and 78', or engages the reaches 94' of said strips, forcing the strips radially outwardly against the interior surface of the side wall 36' of the husk 34', thereby firmly holding both contact strips in place even in the absence of tines, shoulders, ears or channels.

It will be appreciated that by virtue of having the contact and wire-engaging portions of the two contact strips formed as single pieces, many advantages are obtained including those already mentioned, namely, low cost of manufacture of the strips, durability of the strips, reliability of the contacts and, even more importantly, elimination of conventional separate wire terminations such as strips, screws, tines and the like.

The socket is used in a conventional manner with one important exception, namely, because of the presence of the gap 134, the sheathed conductor wires now can be fixed to the wire terminations of the socket either before or after the socket has been physically installed and, thereafter, the sheathed conductor wires can be placed in the nipple of the hickey simply by pushing the same in laterally, this in contrast to previous hickeys in which the conductor wires had to be threaded through the hickey usually before complete installation of the socket. Thereby not only is installation greatly speeded up and rendered easier, but the run of conductor wire can be shortened by pulling on the same before the wires are placed in the hickey, thus making it far simpler to shorten the wires.

It thus will be seen that there are provided devices and a method which achieve the various objects of the invention and which are well adapted to meet the conditions of practical use.

As various possible embodiments might be made of the above invention, and as various changes might be made in the embodiments and method above set forth, it is to be understood that all matter herein described or shown in the accompanying drawings is to be interpreted as illustrative and not in a limiting sense.

Having thus described the invention, there is claimed as new and desired to be secured by Letters Patent:

1. A screw socket into which an electric light bulb having an externally threaded base and an electrically insulated central button contact is insertable and engageable, said socket comprising:

(A) a cylindrical husk of electrically non-conductive material, the interior of the husk being threaded to receive the base of the bulb, said husk having an open mouth at one end and an electrically non-conductive bottom closure wall at the other end, (B) a pair of electrically conductive contact/wire termination strips, (i) each strip constituting a single piece, (ii) each strip being formed to provide a contact at one end thereof and a wire termination at the opposite end, (C) means to anchor and locate said strips in said husk with the contact end of one strip lying alongside and spaced from the side of the husk in a position to be resiliently engaged by the threaded base of the bulb and with the contact end of the other strip crossing the center of the husk near and spaced from the bottom wall so as to be resiliently engaged by the central button of the bulb, said means to anchor said strips in said husk including a tine outwardly struck from each strip, with the free ends of the tines facing the open mouth of the husk, the bases of the tines being in one piece with the strips, and wherein the husk is provided with shoulders that face the bottom closure wall, the tips of the tines abutting the shoulders to prevent movement of the strips in a direction toward the mouth of the husk, said strips having portions butting against the surface of the bottom closure wall which faces the mouth of the husk, (D) said bottom wall having through spaced openings, (i) each opening being in alignment with a different one of the strips, (ii) the wire termination end of each strip lying across the opening associated with that strip, (E) each said wire termination end having an intermediate portion anchored in the husk and a cantilever reach terminating in a tip, the portion of said wire termination end anchored in the husk including said portions of said strips which butt against the inner surface of the bottom closure wall which faces the mouth of the husk, said butting portions of said strips constituting means to hold a portion of each strip between the wire termination end and an intermediate part of the strip under compression and to leave the cantilever reach free to flex, the cantilever reach being aligned with and extending across an associated opening and the tip being near the side wall of the husk so that when a bare wire core is inserted in the opening and thrust against the cantilever reach, the reach will deflect inwardly to permit entry of the wire past the tip and push the entry end of the wire toward the side wall of the husk.

2. A socket as set forth in claim 1 wherein the husk is formed interiorly thereof with slots that extend longitudinally of the husk in a direction from the bottom closure wall to the mouth of the husk, the widths of the slots slightly exceeding the widths of the strips, the strips having portions received in the slots.

3. A socket as set forth in claim 2 in which the slots include flanges extending from the sides of the slots toward the center, and the flanges run in a direction from the bottom wall toward the open mouth of the husk to form channels at the sides of the slots, the strips being provided with laterally extending ears that are slidably received in the channels to assist in locating the strips within the husk.

4. A socket as set forth in claim 1 wherein an electrically non-conductive disc is provided, said disc being located in the husk below the threaded interior of said husk and forcing a portion of each strip between the disc and the bottom closure wall against said bottom closure wall.

5. A socket as set forth in claim 4 wherein the disc is provided with a central opening and wherein the bottom closure wall is provided with a protuberance that extends from said wall toward the mouth of the husk, said protuberance being sized and shaped to be passed through the opening in the disc.

6. A socket as set forth in claim 1 wherein the cantilever reach extends from a part of the socket adjacent the longitudinal axis of the socket radially outwardly at an angle away from the bottom closure wall such that the tip of said reach engages the inserted bare wire core at an angle of less than 90° between the reach and the portion of the core that extends from the reach to the bottom closure wall.

7. A socket as set forth in claim 6 wherein the husk has undercuts in its side wall opposite to the tip of each cantilever reach and against which the reaches urge the inserted ends of the bare wire cores.

8. A socket as set forth in claim 1 wherein the husk is provided with projections on the exterior surface of the husk to form internal pockets having mouths that open at the bottom closure wall, said pockets receiving the wire termination ends of the strips and the adjacent portions of the strips.

9. A socket as set forth in claim 1 wherein the tip of each cantilever reach is provided with a recess at its free edge to engage an inserted bare wire core.

10. A socket as set forth in claim 9 wherein the tip of the cantilever reach of each strip is provided with two adjacent recesses to receive inserted bare wire cores, one for connection to a supply source of electric power and the other for connection in parallel to another electric device.

11. A socket as set forth in claim 10 wherein the tip of each cantilever reach is separated into two adjacent prongs, each of which is formed with one of said recesses in its free edge.

12. A socket as set forth in claim 11 wherein each opening in said bottom closure wall is elongated transversely to the direction between the openings.

13. A socket as set forth in claim 1 which further includes a hickey and means mounting the hickey to the husk on the outside of the bottom closure wall, said hickey comprising a threaded nipple and a footed pedestal, said pedestal including a leg fixed at one end to an end of the nipple, the nipple extending from said leg in a direction away from the husk, and a foot fixed to the other end of the leg, said foot being secured to said husk.

14. A socket as set forth in claim 13 wherein the nipple has a slot in the side wall thereof extending the full length of the nipple for insertion therethrough into the nipple of an insulated electric wire that has been connected from a source of electric power to the wire terminations while the insulated electric wire is external to the nipple.

15. A socket as set forth in claim 1 which further includes a hickey and means mounting the hickey to the husk on the outside of the bottom closure wall, said hickey including a nipple spaced from the husk and having a slot in the side wall thereof extending the full length of the nipple for insertion therethrough into the nipple of an insulated electric wire that has been connected from a source of electric power to the wire terminations while the insulated electric wire is external to the nipple.

16. For use with an electric device, a hickey including a threaded nipple, means for mounting the nipple on the device and spaced therefrom, said nipple having a slot in the side wall thereof extending the full length of the nipple for insertion laterally therethrough into the nipple of an insulated electric wire that has been connected from a source of electric power to a wire termination of the device while the insulated electric wire is external to the nipple.

17. A hickey as set forth in claim 16 which further includes an offset pedestal secured at one end to the nipple and at the other end to a foot extending at right angles to and away from the longitudinal axis of the nipple.

* * * * *